US005160936A

United States Patent [19]

Braun et al.

[11] Patent Number: 5,160,936

[45] Date of Patent: Nov. 3, 1992

[54] MULTIBAND SHARED APERTURE ARRAY ANTENNA SYSTEM

[75] Inventors: John P. Braun, Issaquah; Sperry H. Goodman, Kent; Richard W. Carlson, Seattle, all of Wash.

[73] Assignee: The Boeing Company, Seattle, Wash.

[21] Appl. No.: 640,557

[22] Filed: Jan. 14, 1991

Related U.S. Application Data

[63] Continuation of Ser. No. 386,770, Jul. 31, 1989, abandoned.

[51] Int. Cl.[5] ..... H01Q 21/240; H01Q 5/010; H01Q 1/380; H01Q 13/180

[52] U.S. Cl. ..... 343/725; 343/700 MS; 343/771

[58] Field of Search ..... 343/700 MS, 725, 729, 343/767, 770, 771, 829, 846, 726, 727, 728

[56] References Cited

U.S. PATENT DOCUMENTS

| | | | |
|---|---|---|---|
| 2,654,842 | 10/1953 | Engelmann | 250/33 |
| 3,121,230 | 2/1964 | Brueckmann | 343/770 |
| 3,193,830 | 7/1965 | Provencher | 343/729 |
| 3,243,818 | 3/1966 | Holtzman | 343/771 |
| 3,518,688 | 6/1970 | Stavboldt et al. | 343/700 MS |
| 3,623,111 | 11/1971 | Provencher et al. | 343/727 |
| 3,691,563 | 9/1972 | Shelton | 343/771 |
| 3,771,158 | 11/1973 | Hatcher | 343/728 |
| 3,911,443 | 10/1975 | Korta et al. | 343/767 |
| 4,110,751 | 8/1978 | Reggia et al. | 343/700 MS |
| 4,263,598 | 4/1981 | Bellee et al. | 343/700 MS |
| 4,364,050 | 12/1982 | Lopez | 343/700 MS |
| 4,450,449 | 5/1984 | Jewitt | 343/700 MS |
| 4,691,206 | 9/1987 | Shapter et al. | 343/700 MS |
| 4,766,440 | 8/1988 | Gegan | 343/700 MS |
| 4,864,314 | 9/1989 | Bond | 343/700 MS |
| 4,951,060 | 8/1990 | Cohn | 342/372 |
| 5,001,493 | 3/1991 | Patin et al. | 343/700 MS |

FOREIGN PATENT DOCUMENTS

| | | | |
|---|---|---|---|
| 0188345 | 7/1986 | European Pat. Off. | 343/700 MS |
| 0184805 | 10/1983 | Japan | 343/700 MS |
| 2101410 | 1/1983 | United Kingdom | 343/700 MS |
| 2131232 | 6/1984 | United Kingdom | 343/700 MS |
| 2157500 | 11/1985 | United Kingdom | 343/700 MS |

OTHER PUBLICATIONS

Maillous et al., "Microstrip Array Technolgy," IEEE Transactions on Antennas and Propagation, vol. AP-29, No. 1, Jan. 1961, pp. 25-67.

Chen et al., "A Dual Frequency Antenna with Dichroic Reflector and Microstrip Array Sharing a Common Aperture," Conference: B52 1982, APS International Symposium Digest, Antennas and Propagation, Albuquerque, N. Mex., May 24-28, 1982, pp. 296-299.

*Primary Examiner*—Michael C. Wimer
*Assistant Examiner*—Peter Toby Brown
*Attorney, Agent, or Firm*—Finnegan, Henderson, Farabow, Garrett & Dunner

[57] ABSTRACT

A lightweight phased array antenna systems that is conformable to an aircraft fuselage combines air-filled cavity-backed slots with printed circuit elements for operation in two or more frequency bands. The printed circuit elements are separated from a conductive ground plane in which the slots are cut by a dielectric honeycomb material. The slots and printed circuit elements are individually excitable by a multiband feed network and transmit/receive modules for operation in the UHF band and S band or L band, respectively.

20 Claims, 6 Drawing Sheets

MULTIBAND SHARED APERTURE ARRAY ANTENNA SYSTEM

This application is a continuation of application Ser. No. 07/386,770, filed Jul. 31, 1989, now abandoned.

BACKGROUND OF THE INVENTION

The present invention relates to array antenna systems, and more particularly to phased array antenna systems operating in two or more frequency bands.

Advanced airborne radar systems require lightweight phased array antenna systems capable of operating in two or more frequency bands that are conformable to an aircraft fuselage. The array antennas used for the two or more frequency bands must physically overlap because of the limited area available on an aircraft.

There have been many attempts to develop dual or multiband antenna systems. For example, extremely broad bandwidth or frequency independent elements such as log-periodic dipoles and spirals have been developed for applications other than phased arrays. For application in phased arrays, however, the elements must be spaced approximately one-half wavelength apart at all operating bands. This spacing obviously cannot be maintained with frequency independent elements in an array with many elements.

Other attempts to develop dual-band arrays have centered on combining two sets of elements where each operates over a limited bandwidth. One example is an array of dipoles operating at a low frequency band mounted in front of a slotted waveguide array operating at a higher frequency band. The dipoles and waveguide slots are cross-polarized to minimize interaction, and the waveguide array surface acts as a ground plane for the dipole array. Another example is the combination of an array of waveguide-dipole dual-polarization elements operating at a high frequency band with an array of waveguide or waveguide-dipole elements operating at a low frequency band. Both of these examples, however, require considerable depth behind the aperture planes, and are poorly suited for arrays conforming to a curved aircraft fuselage.

In another example of a dual-band array, stripline-fed cavity backed-slots operating at a high frequency band are interspersed with stripline-fed crossed cavity-backed slots operating at a low frequency band. The dielectric-filled cavities are on different layers of a complex multilayer stripline feed circuit. Although this array is conformable to an aircraft fuselage, the use of teflon-fiberglass dielectric materials makes it heavy for aircraft applications, particularly at low frequencies.

SUMMARY OF THE INVENTION

Accordingly, it is an object of the present invention to provide a lightweight phased array antenna system capable of operating in two or more frequency bands that is conformable to an aircraft fuselage.

Additional objects and advantages of the invention will be set forth in part in the description which follows, and in part will be obvious from the description, or may be learned by practice of the invention. The objects and advantages of the invention will be realized and obtained by means of the elements and combinations particularly pointed out in the appended claims.

To achieve the objects of the invention, and in accordance with its purposes, as embodied and broadly described here, the invention comprises a conductive ground plane, a plurality of mutually spaced printed circuit elements forming a first array antenna operative at a first nominal frequency band, means for supporting the printed circuit elements separated from and parallel to the ground plane, the ground plane having a plurality of slots mutually spaced and positioned between predetermined ones of the printed circuit elements, the slots forming a second array antenna operative at a second nominal frequency band, and means for individually exciting each of the printed circuit elements to radiate energy at the first nominal frequency band and each of the slots to radiate energy at the second nominal frequency band.

In a preferred embodiment of the invention, the means for individually exciting each of the printed circuit elements and each of the slots comprises a plurality of nonresonant air filled waveguide cavities mounted to the ground plane opposite the printed circuit elements, each of the waveguide cavities communicating with one of the slots, a feed network coupled to the printed circuit elements and the waveguide cavities for feeding signals at the first and second nominal frequency bands to the printed circuit elements and the waveguide cavities, respectively, and means coupled between the feed network and the printed circuit elements and the waveguide cavities for individually controlling the phase and amplitude of the signals from the feed network to each of the printed circuit elements and each of the waveguide cavities.

In an alternate embodiment of the invention capable of operating in three frequency bands, the slots form second and third array antennas operative at second and third nominal frequency bands, respectively, and the exciting means individually excites each of the slots to radiate energy at the second nominal frequency band and predetermined groups of the slots to radiate energy at the third nominal frequency band.

Another embodiment of the invention, also capable of operating in three frequency bands, additionally comprises a plurality of second slots mutually spaced and positioned between predetermined other ones of the printed circuit elements, the second slots forming a third array antenna operative at a third nominal frequency band, and the exciting means individually excites each of the second slots to radiate energy at the third nominal frequency band.

It is to be understood that both the foregoing general description and the following detailed description are exemplary and explanatory only and are not restrictive of the invention as claimed.

The accompanying drawings, which are incorporated in and constitute a part of the specification, illustrate several embodiments of the invention and together with the general description, serve to explain the principles of the invention.

DESCRIPTION OF THE PREFERRED EMBODIMENTS

Reference will now be made in detail to the presently preferred embodiments of the invention, examples of which are illustrated in the accompanying drawings. Wherever possible, the same reference numbers will be used throughout the drawings to refer to the same or like parts.

Figure 1:
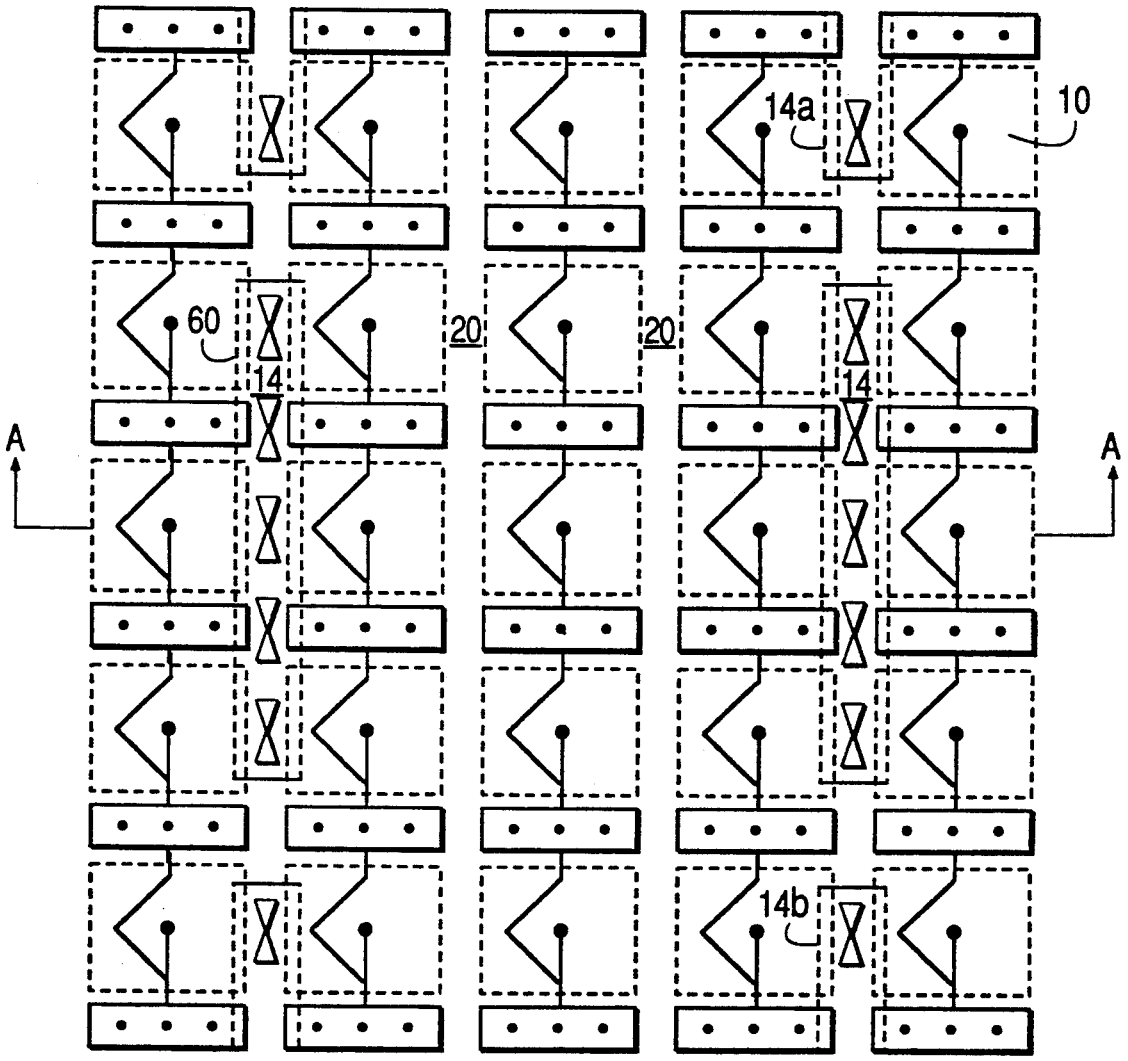
FIG. 1 is a plan view of the aperture of the array antenna system according to a first embodiment of the invention with an exemplary frequency selective surface depicted.

FIG. 1 is a plan view of the aperture of the array antenna system according to a first embodiment of the invention. As shown in FIG. 1, a plurality of printed circuit elements 10 are mutually spaced in an array separated from, and parallel to, a conductive ground plane 12. The printed circuit elements 10, one of which is shown in greater detail in FIG. 2, form a first array antenna operative at a first nominal frequency band. The printed circuit elements 10 are spaced approximately one-half wavelength apart at the first nominal frequency band and produce vertical polarization in the orientation shown in FIG. 1.

Figure 2:
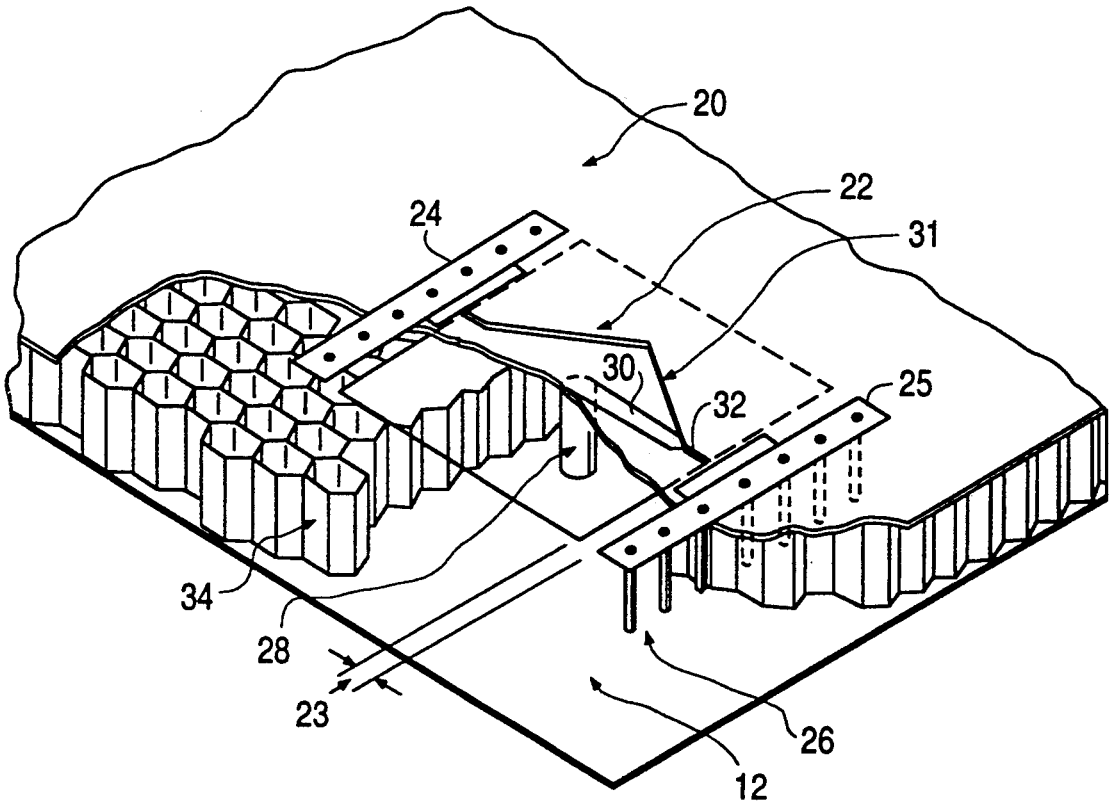
FIG. 2 is a perspective view of an exemplary printed circuit element used in the invention.

As further shown in FIG. 2, each printed circuit element 10 is printed on both sides of a teflon-fiberglass substrate 20. A square radiating metal patch element 22 is printed on the bottom of the substrate 20. Two metal strips 24 and 25 are printed on the top of the substrate 20 spaced away from the square patch element 22 to form a gap 23 at either end. Each of the metal strips 24 and 25 are electrically connected to a plurality of grounding pins 26 which are connected to the ground plane 12. The grounding pins 26 create an electric wall or "fence" between the printed circuit elements.

The cavity space between the printed circuit elements 10 and the ground plane 12 is filled by a dielectric honeycomb material 34. The honeycomb material 34 supports the substrate 20 and provides solidity to the design while maintaining a light weight.

The printed circuit element 10 is fed by a coaxial feed cable 28 through the ground plane 12. The outer shield of the coaxial feed cable 28 is shorted to the ground plane 12 and the center of square patch element 22. The center of the coaxial feed cable 28 is electrically connected to a metal strip 30 printed on the top of substrate 20. Metal strip 30 is electrically connected by microstrip feed lines 31 and 32 to the metal strips 24 and 25, respectively.

Each printed circuit element 10 is essentially a cavity backed slot antenna with two parallel slots formed by the gaps 23 at either end of the square patch element 22. The slots operate as a single antenna. The length of microstrip feed line 31 is approximately one-half wavelength at the first nominal frequency band so that one slot is fed 180' out of phase with respect to the other slot. In this configuration, the radiating beam peak is at the broadside of the slots.

Depending on the dimensions of the printed circuit elements 10, the first nominal frequency band may be, for example, in the L band or in the S band. For operation in the L band, the printed circuit elements may be approximately 4.5 inches by 4 inches and spaced apart approximately 4.5 inches. For operation in the S band, the printed circuit elements may be approximately 1.8 inches by 1.6 inches and spaced apart approximately 1.8 inches.

Interspersed with printed circuit elements 10 at regular intervals are slots 14 cut in the ground plane 12. The slots 14 form a second array antenna operative at a second nominal frequency band. The slots 14 are spaced approximately one-half wavelength apart at the second nominal frequency band and produce horizontal polarization in the orientation shown in FIG. 1. In order to prevent energy at the first nominal frequency band from coupling into the slots, the slots may be covered with a frequency selective surface 60 or loaded by resonant circuits which present a short at the first nominal frequency band.

In the embodiment of FIG. 1, there are nine printed circuit elements 10 for every slot 14, implying a 3:1 ratio between the first and second nominal frequency bands. In practice, any integral ratio between the number of printed circuit elements and the number of slots, and thus the first and second nominal frequency bands, may be used.

The present invention also includes means for individually exciting each of the printed circuit elements to radiate energy at the first nominal frequency band and each of the slots to radiate energy at the second nominal frequency band. According to one embodiment of the invention, the exciting means includes a plurality of nonresonant air-filled waveguide cavities mounted to the ground plane opposite the printed circuit elements.

Figure 3:
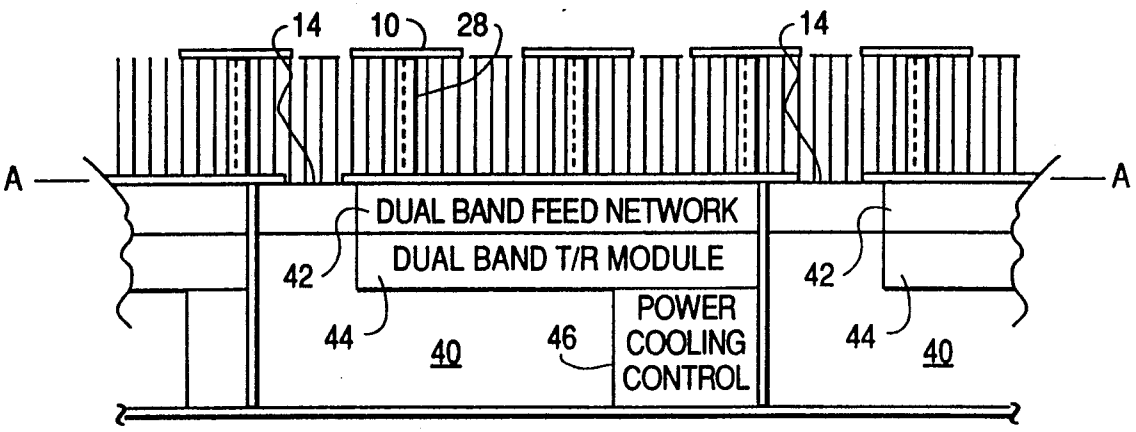
FIG. 3 is a cross-section at A—A corresponding to the aperture of FIG. 1 in which the array antenna system is configured for dual-band operation.

FIG. 3 is a cross-section corresponding to the aperture of FIG. 1 in which the array antenna system is configured for dual-band operation. As shown in FIG. 3, waveguide cavities 40 are mounted to the ground plane 12 opposite the printed circuit elements 10. Each one of the waveguide cavities 40 communicates with one of the slots 14. A dual-band feed network 42 of microstrip or stripline transmission lines is also coupled to the printed circuit elements 10 through the coaxial feeds 28 and to the waveguide cavities 40 for feeding signals at the first and second nominal frequency bands to the printed circuit elements and the waveguide cavities, respectively.

In order to scan the beams of the first and second array antennas, there is also provided means coupled between the feed network and the printed circuit elements and the waveguide cavities for individually controlling the phase and amplitude of the signals from the feed network to each of the printed circuit elements and each of the waveguide cavities. As embodied in FIG. 3, dual-band transmit/receive (T/R) modules 44 containing at least a phase shifter for each printed circuit element and each slot are provided. Each T/R module 44 feeds nine printed circuit elements and one slot. Each T/R module is fed from the dual-band feed network 42.

A channel 46 for electrical power, control signals, and cooling is also shown as part of the waveguide cavity walls. This channel may also be incorporated as part of the aircraft structure.

Figure 4:
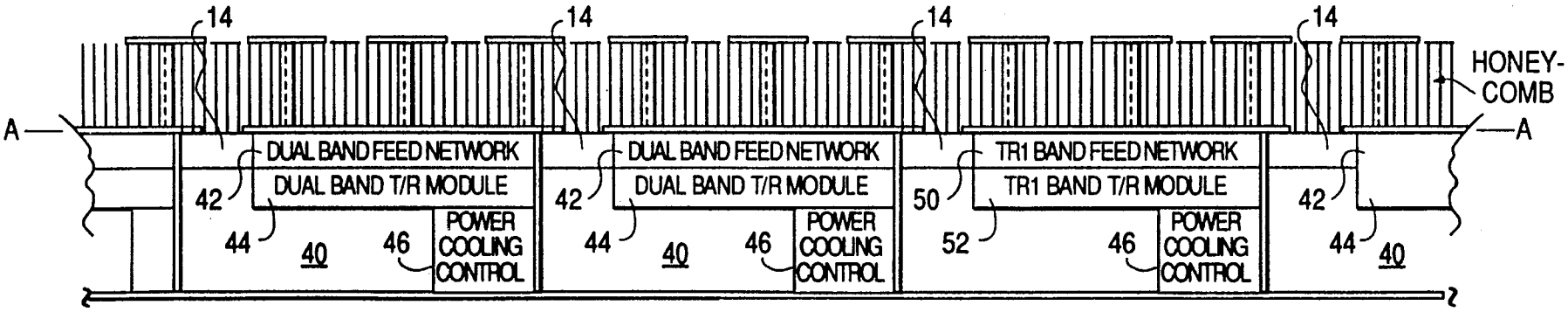
FIG. 4 is an extended cross-section at A—A corresponding to the aperture of FIG. 1 in which the array antenna system is configured for tri-band operation.

The embodiment of the array antenna system in FIG. 1 may also be operated at a third nominal frequency band as a tri-band array antenna system. In the cross-section of FIG. 4, which shows a tri-band configuration of the array antenna system corresponding to the aperture of FIG. 1 every third column of slots 14 is fed by a tri-band feed network 50 and tri-band T/R modules 52 to provide operation at a third nominal frequency band that is one-third the second nominal frequency band. Three adjacent slots 14, 14*a* and 14*b* are combined to effectively form a single longer slot which supports propagating waveguide at the third nominal frequency band. Active impedance matching is needed to operate the slots at two different frequency bands, however, and diode switching or resonant networks are needed to suppress unwanted modes and coupling.

Figure 5:
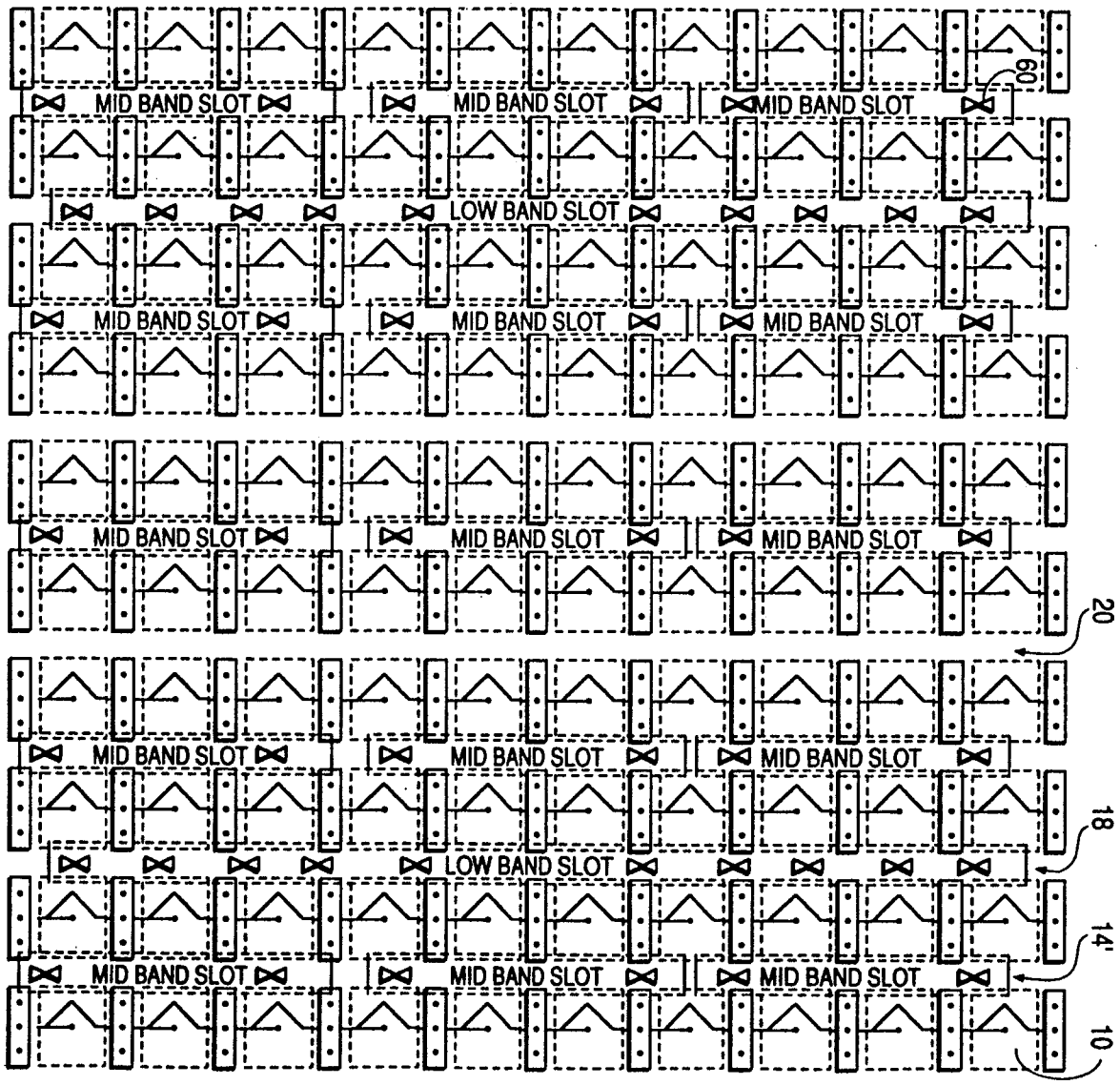
FIG. 5 is a plan view of the aperture of the array antenna system according to a second embodiment of the invention for tri-band operation with an exemplary frequency selective surface depicted.

FIG. 5 is a plan view of the aperture of the array antenna system according to a second embodiment of the invention for tri-band operation. In this embodiment, physically separate slots are cut in the ground plane for operation at the second and third nominal frequency bands.

As shown in FIG. 5, there are six printed circuit elements 10 for every slot 14', having approximately a 2:1 ratio between the first nominal frequency band and the second nominal frequency band. Interspersed with the printed circuit elements 10 and the slots 14' at regular intervals are slots 18 cut in the ground plane 12. Slots 18 form a third array antenna operative at a third nominal frequency band. In FIG. 5, there are sixty printed circuit elements 10 for every slot 18 and nine slots 14' for every slot 18, implying a 6:1 ratio between the first and third nominal frequency bands and a 3:1 ratio between the second and third nominal frequency bands, respectively. Physically separate slots for the second and third nominal frequency bands eliminates the need for diode switching or resonant circuits to suppress unwanted modes and coupling, but is more difficult to implement mechanically than the shared-slot tri-band configuration shown in FIG. 4.

Figure 6:
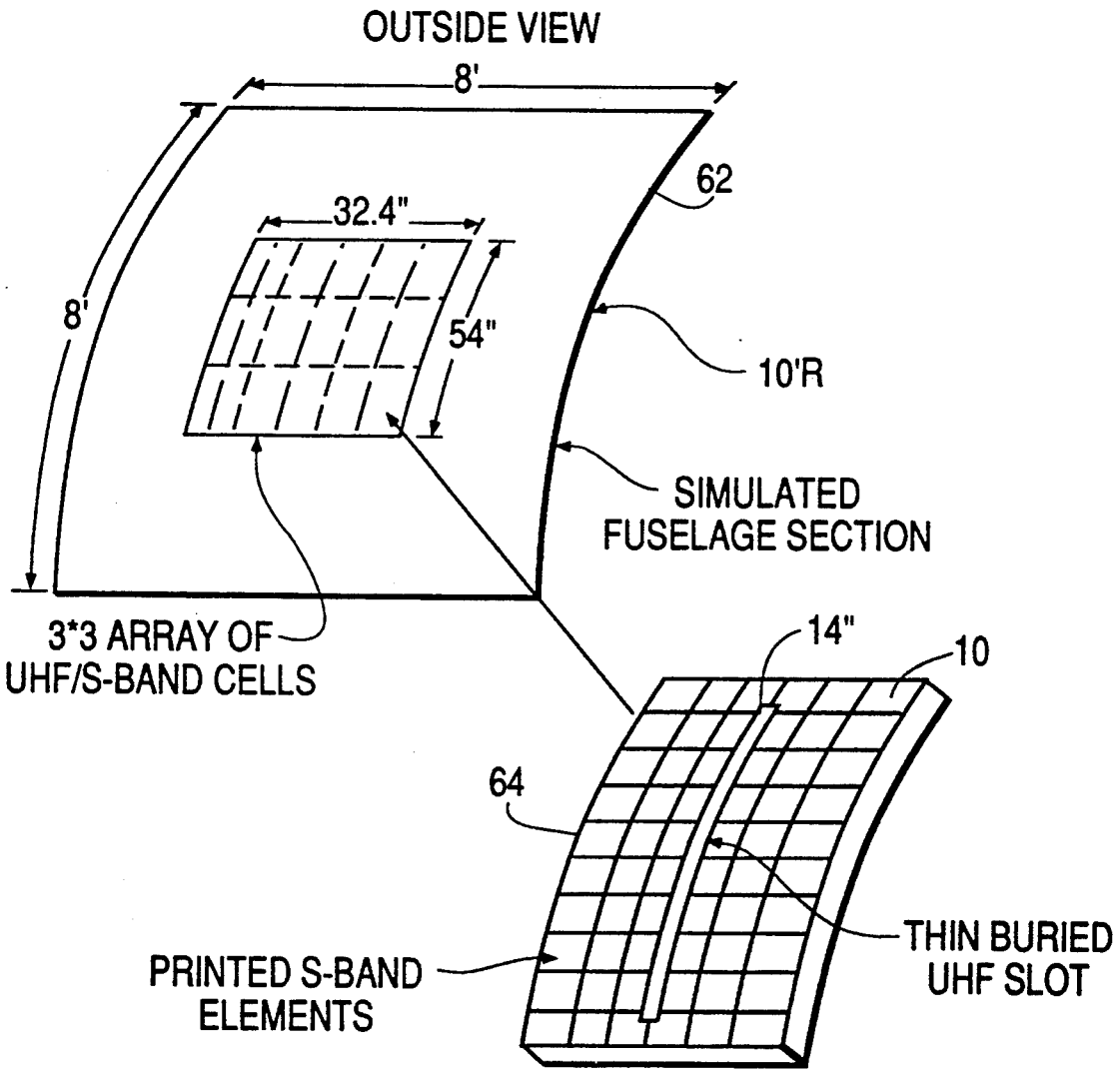
FIG. 6 is an outside view of a dual-band application of the invention for an aircraft fuselage.
Figure 7:
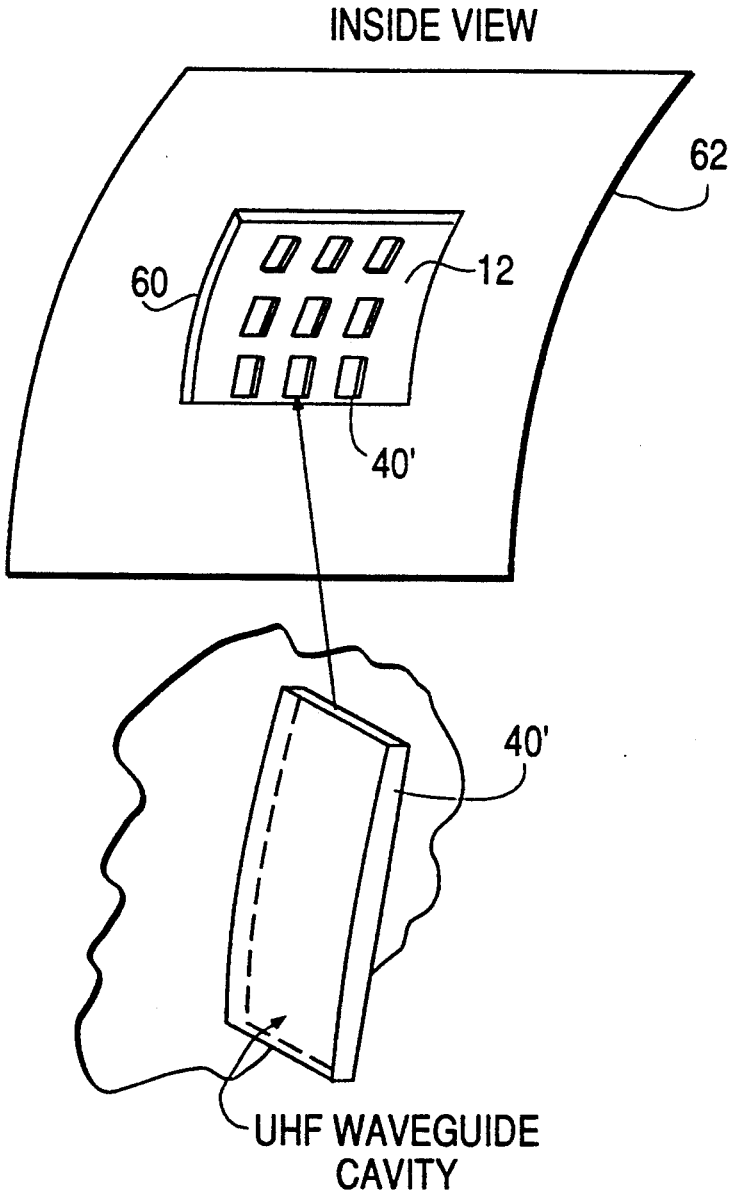
FIG. 7 is an inside view of the dual-band application of FIG. 6.

FIGS. 6 and 7 show a dual-band application of the invention for an aircraft fuselage using array unit cells. By constructing the array antenna system of periodically arranged array unit cells, the array antenna system of the invention can be expanded to form an arbitrarily large aperture.

FIG. 6 shows a 32.4 inch by 54 inch aperture 60 mounted on a section of aircraft fuselage measuring eight feet by eight feet and having a radius of ten feet. The aperture 60 of the array antenna system is made up of nine UHF/S band array unit cells 64. In this embodiment, each array unit cell 64 has sixty printed circuit elements 10 and one slot 14''. Each of the printed circuit elements 10 is individually excitable to radiate energy at a first nominal frequency band in the S band. Likewise, each of the slots 14'' in each array unit cell 64 is individually excitable to radiate energy at a second nominal frequency band in the UHF band.

FIG. 7 shows an inside view of the fuselage section 62 of FIG. 6 and the back of the array antenna system. A plurality of nonresonant air-filled waveguide cavities 40' are mounted orthogonally to the ground plane 12 with slots 14'' forming apertures in the ends of the waveguide cavities. The total depth of the antenna system may be approximately six inches when the power distribution network and T/R modules are installed on the back of the array, and therefore, the waveguide cavities 40' may also be, for example, six inches deep.

It will be apparent to those skilled in the art that various modifications and variations can be made in the antenna system of the present invention and in construction of this antenna system without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A multiband shared aperture array antenna system requiring high-gain antenna patterns, comprising:
   - a conductive ground plane;
   - a plurality of mutually spaced printed circuit elements forming a first array antenna operative at a first nominal frequency band;
   - means for supporting said printed circuit elements separated from and parallel to said ground plane;
   - said ground plane having a plurality of slots mutually spaced and positioned between predetermined ones of said printed circuit elements, said slots forming a second array antenna operative at a second nominal frequency band lower than the first nominal frequency band, said slots being covered with a frequency selective surface to prevent coupling of the first nominal frequency into the slots; and
   - means for individually exciting each of said printed circuit elements to radiate energy at the first nominal frequency band and each of said slots to radiate energy at the second nominal frequency band lower than the first nominal frequency band, each frequency capable of being radiated independent of the other frequency.

2. The antenna system of claim 1, wherein said printed circuit elements are mutually spaced approximately one-half wavelength apart at the first nominal frequency band and said slots are mutually spaced approximately one-half wavelength apart at the second nominal frequency band.

3. The antenna system of claim 1, wherein the number of printed circuit elements is an integral multiple of the number of slots and the first nominal frequency band is an integral multiple of the second nominal frequency band.

4. The antenna system of claim 1, wherein the first array antenna is orthogonally polarized with respect to the second array antenna.

5. The antenna system of claim 1, wherein the first nominal frequency band is in the L band and the second nominal frequency band is in the UHF band.

6. The antenna system of claim 1, wherein the first nominal frequency band is in the S band and the second nominal frequency band is in the UHF band.

7. The antenna system of claim 1, wherein each of said printed circuit elements comprises a dual-slot radiating element.

8. The antenna system of claim 1, wherein said supporting means comprises a dielectric honeycomb material.

9. The antenna system of claim 1, wherein said exciting means includes a plurality of nonresonant air-filled waveguide cavities mounted to said ground plane opposite said printed circuit elements, each of said waveguide cavities communicating with one of said slots.

10. The antenna system of claim 9, wherein said exciting means further includes a feed network coupled to said printed circuit elements and said waveguide cavities for feeding either harmonically or non-harmonically related signals at the first nominal frequency band to said printed circuit elements and at the second lower nominal frequency band to the waveguide cavities.

11. The antenna system of claim 10, wherein said exciting means further includes a transmit/receive module coupled between said feed network and said printed circuit elements and said waveguide cavities for individually controlling the harmonically or non-harmonically related signals from said feed network and wherein said transmit/receive module includes means for individually controlling the phase and amplitude of said signals from said feed network, to each of said printed circuit elements and each of said waveguide cavities.

12. A multiband shared aperture array antenna system requiring high-gain antenna patterns, comprising:

a conductive ground plane;

a plurality of mutually spaced printed circuit elements forming a first array antenna operative at a first nominal frequency band;

means for supporting said printed circuit elements separated from and parallel to said ground plane;

said ground plane having a plurality of first slots mutually spaced and positioned between predetermined ones of said printed circuit elements, said first slots forming a second array antenna operative at a second nominal frequency band lower than the first nominal frequency band;

said ground plane having a plurality of second slots mutually spaced and positioned between predetermined other ones of said printed circuit elements, said second slots forming a third array antenna operative at a third nominal frequency band lower than the second nominal frequency band, said first and second slots being covered by a frequency selective surface to prevent coupling of the first nominal frequency into the first and second slots; and means for individually exciting each of said printed circuit elements to radiate energy at the first nominal frequency band and each of said first slots to radiate energy at the second lower nominal frequency band and each of said second slots to radiate energy at the third lowest nominal frequency band, each frequency capable of being radiated independent of the other frequencies.

13. The antenna system of claim 12, wherein said printed circuit elements are spaced approximately one-half wavelength apart at the first nominal frequency band and said first and second slots are spaced approximately one-half wavelength apart at the second and third nominal frequency bands, respectively.

14. The antenna system of claim 12, wherein the number of printed circuit elements is an integral multiple of the number of both the first and second slots and the first nominal frequency band is an integral multiple of both of the second and third nominal frequency bands.

15. The antenna system of claim 12, wherein the first array antenna is orthogonally polarized with respect to the second and third array antennas.

16. The antenna system of claim 12, wherein each of said printed circuit elements comprises a dual-slot radiating element.

17. The antenna system of claim 12, wherein said supporting means comprises a dielectric honeycomb material.

18. The antenna system of claim 12, wherein said exciting means includes a plurality of nonresonant air-filled waveguide cavities mounted to said ground plane opposite said printed circuit elements, each of said waveguide cavities communicating with one of said first and second slots.

19. The antenna system of claim 18, wherein said exciting means further includes a feed network coupled to said printed circuit elements and said waveguide cavities for feeding either harmonically or non-harmonically related signals at the first nominal frequency band to said printed circuit elements, at the second lower nominal frequency band to the respective ones of said waveguide cavities communicating with said first slots, and at the third lowest nominal frequency band to the respective ones of said waveguide cavities communicating with said second slots.

20. The antenna system of claim 19, wherein said exciting means further includes a transmit/receive module coupled between said feed network and said printed circuit elements and said waveguide cavities for individually controlling the harmonically or non-harmonically related signals from said feed network and wherein said transmit/receive module includes means for individually controlling the phase and amplitude of said signals form said feed network, to each of said printed circuit elements and each of said waveguide cavities.

* * * * *